US008925423B1

(12) United States Patent
Rotolo

(10) Patent No.: US 8,925,423 B1
(45) Date of Patent: Jan. 6, 2015

(54) RETRACTABLE BOTTLE OPENER AND METHOD OF USE

(71) Applicant: Anthony John Rotolo, Fort Lauderdale, FL (US)

(72) Inventor: Anthony John Rotolo, Fort Lauderdale, FL (US)

(73) Assignee: Bottle Ops, Fort Lauderdale, FL (US)

( * ) Notice: Subject to any disclaimer, the term of this patent is extended or adjusted under 35 U.S.C. 154(b) by 0 days.

(21) Appl. No.: 14/169,259

(22) Filed: Jan. 31, 2014

(51) Int. Cl.
*B67B 7/44* (2006.01)
*B67B 7/16* (2006.01)

(52) U.S. Cl.
CPC ..... *B67B 7/16* (2013.01)
USPC ..... 81/3.09; 7/151; 81/3.57

(58) Field of Classification Search
USPC ..... 81/3.09, 3.55, 3.57; 7/151
See application file for complete search history.

(56) References Cited

U.S. PATENT DOCUMENTS

| | | | | |
|---|---|---|---|---|
| 2,447,381 | A | 8/1948 | White | |
| 2,665,478 | A * | 1/1954 | Clemens | 30/297 |
| 4,384,390 | A * | 5/1983 | Hayakawa | 7/151 |
| 4,986,459 | A * | 1/1991 | Yarbrough, Jr. | 224/661 |
| 5,133,233 | A | 7/1992 | Erwin | |
| 5,261,299 | A | 11/1993 | Kondos | |
| 6,098,497 | A | 8/2000 | Larose | |
| 6,185,772 | B1 * | 2/2001 | Bates | 7/151 |
| 6,761,088 | B1 | 7/2004 | Sasso | |
| 7,484,249 | B1 * | 2/2009 | Reese et al. | 2/48 |
| 7,617,748 | B1 | 11/2009 | Chenelia | |
| 7,966,910 | B1 | 6/2011 | Cece | |
| 8,205,527 | B2 | 6/2012 | Chenelia | |
| 8,549,667 | B1 * | 10/2013 | Fuller | 81/3.55 |
| 8,607,668 | B1 * | 12/2013 | Frank et al. | 81/3.09 |
| 2007/0163393 | A1 * | 7/2007 | Ondeck et al. | 81/3.57 |
| 2008/0127782 | A1 | 6/2008 | O'Brien | |
| 2008/0173135 | A1 * | 7/2008 | Beard | 81/3.09 |
| 2009/0049956 | A1 | 2/2009 | Brennan | |
| 2011/0179545 | A1 | 7/2011 | Rummel | |

* cited by examiner

*Primary Examiner* — Hadi Shakeri
(74) *Attorney, Agent, or Firm* — Scott D. Smiley; Mark C. Johnson; The Concept Law Group, P.A.

(57) ABSTRACT

A retractable bottle opener with a wearable wrist band coupled to a wrist-arm area of a user, a first end positioned proximal to the wrist area of the user, and a second end positioned on a forearm of the user, and a bottle opener coupled to the wearable wrist band. The opener has a first end, a second end, an opener length separating the first and second ends of the bottle opener, a working surface shaped to engage with a bottle, and a handle portion. Further, the retractable bottle has a storage position along an opener translation path with both the working surface and the handle portion disposed at least one of along the forearm of the user and proximal to the wrist area of the user and an operational position along the opener translation path with both the working surface and the handle portion disposed in a user's hand.

19 Claims, 10 Drawing Sheets

100

A-A

100

100

900

900

RETRACTABLE BOTTLE OPENER AND METHOD OF USE

FIELD OF THE INVENTION

The present invention relates generally to bottle openers, and more particularly relates to a wearable bottle opener that is movable from one position on a user's arm to another position that is operable to open a bottle.

BACKGROUND OF THE INVENTION

The present invention relates generally to a wearable device used to remove a cap off a bottle. A bottle opener is generally a tool that enables the removal of bottle caps from bottles. The bottle opener can also include corkscrews used to remove cork or plastic stoppers from wine bottles. The bottle opener is necessary due to the snug fit that a bottle cap often has on a bottle. A bottle cap is generally affixed to the rim of the neck of a bottle by being pleated or crimped around the rim of the bottle.

Typically, a bottle opener is a specialized lever with a rectangular or rounded opening in one end and a solid handle large enough to be gripped between the thumb and forefingers on the other. The opening contains a lip that is placed under the edge of the bottle top, pulling it off when an upward force is applied to the handle end of the opener. Most bottle openers are easily transported, but are unable to be stored in a convenient place that is quickly accessible by a user. This can be very problematic for those users in restaurants, bars, and sporting events, who generally resort to storing the opener in their pockets and/or waistbands of their clothing or at a particular location in the bar or restaurant that makes quick and efficient access difficult.

Those known wearable bottle openers are generally incorporated onto a garment, e.g., a glove, or a piece of jewelry, e.g., a watch or ring. They are mostly placed fixed in position on the user such that a user does not have the ability to conceal it from the viewing public, if desired. Many of those known wearable bottle openers are positioned on the user, e.g., on the user's fingers, such that they are difficult to manipulate over a cap of a bottle. Any available devices that provide the user the ability to use his or her palm as a means to grip or support the bottle opener when in use also include their own disadvantages. For example, these devices are fixed in a position of the user's palm such that the user is continually required to hold the device in his or palm, unless the device is removed, with the wearable element of assembly. Therefore, when not in operation, the user loses some of the utility and effectiveness of his or her hand. When used in a bar or restaurant setting, inhibiting the utility of a user's hand is also extremely problematic. As such, having a bottle opener that is discrete and practical when not in operation, yet functional when in use, is lacking in those known devices.

Some known wearable bottle openers include a wristband with an attached member having a rounded opening. The wrist is a joint or articulation between the forearm and the hand. Wristbands are encircling strips worn on the wrist, made from a variety of materials depending on the purpose. A wrist band includes a length wound at least one turn around the wrist, and including pieces of wrist Velcro attached at a predetermined position so as to press and fix the wrist in a state of being wound around the wrist. These wristbands provide similar disadvantages as those other known devices. For example, they are difficult to manipulate the rounded opening over a cap of a bottle, because it cannot be readily visualized by the user and/or the user is not accustomed to opening bottles utilizing only their wrists. Additionally, the exertion of continual force on the user's wrist by the bottles that are opened causes pain to many users and expedites degenerative failure of tissues and bones found in the wrist.

Therefore, a need exists to overcome the problems with the prior art as discussed above.

SUMMARY OF THE INVENTION

The present invention obviates the above-mentioned problems, by providing a retractable and wearable bottle opener that is positioned in a storage position on a user's wristband and caused to move to an operational position in a user's palm. In one embodiment, an impetus is initiated by a limb of a user to create sufficient force to disengage an operational end of the bottle opener from the storage position to the operational position. In other embodiments, the operational end of the bottle opener is impelled through various other means to the operational position and retractable to the storage position that is discretely concealed to the viewing public.

With the foregoing and other objects in view, there is provided, in accordance with the invention, a retractable bottle opener that includes a wearable wrist band coupled to a wrist-arm area of a user and has a first end positioned proximal to the wrist area of the user, a second end opposite the first end and positioned on a forearm of the user, a band length spanning from the first end to the second end of the wrist band, an outer surface, and an inner surface. The retractable bottle opener also includes a bottle opener coupled to the wearable wrist band. The bottle opener has a (1) first end, (2) a second end, (3) an opener length separating the first and second ends of the bottle opener, (4) a working surface shaped to engage with a bottle and disposed along the opener length, a handle portion disposed along the opener length, (5) a storage position along an opener translation path with both the working surface and the handle portion disposed either along the forearm of the user and/or proximal to the wrist area of the user, and (6) an operational position along the opener translation path with both the working surface and the handle portion disposed in a user's hand.

In accordance with a further feature of the present invention, the operational position includes the handle portion disposed in a palm of the user's hand.

In accordance with another feature, an embodiment of the present invention includes a pivot member with a first end directly coupled to the wearable wrist band and a second free end positioned a distance away from the wearable wrist band and pivotably attached to the bottle opener. The bottle opener is then operably rotated to and from the storage position and the operational position.

In accordance with yet another feature, an embodiment of the present invention includes the wearable wrist band also has a magnet operable to retain the bottle opener in the storage position proximal to the outer surface of the wearable wrist band.

In accordance with an additional feature of the present invention, the bottle opener is operably placed in the operational position through an impetus generated by a user's arm, the impetus being a force sufficient to overcome a magnetic force used to retain the bottle opener.

In accordance with another feature of the present invention, the opener translation path is of a substantially circular motion.

In accordance with yet another feature of the present invention, the opener translation path is of a linear motion.

In accordance with an additional feature, an embodiment of the present invention includes a spring-like device coupled to the wearable wrist band and operable to impel the bottle opener to at least one of the storage position to the operational position.

In accordance with yet another feature, an embodiment of the present invention includes the wearable wrist band having a light emitting device operably emitting a light in a direction toward the user's hand only when the bottle opener is placed in the operational position.

Another embodiment of the present invention includes a wearable wrist band with a first end defining a first aperture, a second end opposite the first end and defining a second aperture, a band length spanning from the first end to the second end of the wrist band, an outer surface, and an inner surface defining a channel spanning from the first aperture to the second aperture and sized to receive a user's limb. The second end of the wrist band also has a terminal outer edge. The bottle opener assembly also includes a bottle opener coupled to the wearable wrist band. The bottle opener has a first end, a second end, an opener length separating the first and second ends of the bottle opener, a working surface shaped to engage with a bottle and disposed along the opener length, a handle portion disposed along the opener length, a storage position along an opener translation path with both the working surface and the handle portion disposed either along the band length and/or proximal to the first and second ends of the wrist band, and an operational position along the opener translation path with the working surface and the handle portion not disposed along the band length and displaced at a distance removed from the terminal outer edge of the second end of the wrist band.

In accordance with a further feature of the present invention, the channel is sized to receive a user's wrist.

In accordance with another feature, an embodiment of the present invention includes the wearable wrist band having a fastener positioned on the outer surface of the wrist band and sized to receive at least one auxiliary item, the at least one auxiliary item including either a writing device, a lighter, and/or a light emitting device.

In accordance with yet another feature, an embodiment of the present invention includes the wearable wrist band having a marking portion configured to display illuminated text, graphics, and/or other decorative markings.

In accordance with an additional feature, an embodiment of the present invention includes a reel coupled to the wearable wrist band and a retractable and pliable cord with a first end directly coupled to the reel and a second end attached to the bottle opener. As such, the bottle opener is then operably placed in the storage position and the operational position by the cord.

In accordance with the present invention, a method of using and storing a wearable bottle opener is disclosed and includes the steps of providing a wearable wrist band and a bottle opener coupled thereto. The wrist band has a first end defining a first aperture, a second end opposite the first end and defining a second aperture, a band length spanning from the first end to the second end of the wrist band, an outer surface, and an inner surface defining a channel spanning from the first aperture to the second aperture and sized to receive a user's arm. The assembly also has a bottle opener with an opener length separating a first end and a second end of the bottle opener, a working surface shaped to engage with a bottle, and a handle portion. The method includes encapsulating the wearable wrist band to the user's arm such that the first end is positioned proximal to a wrist area of a user and the second end is positioned on a forearm of the user, retaining the bottle opener on the wearable wrist band such that both the working surface and the handle portion are disposed at least one of along the forearm of the user and proximal to the wrist area of the user, and impelling the bottle opener in a direction away from the wearable wrist band such that both the working surface and the handle portion are disposed in a user's hand.

In one embodiment, a band portion fastens to a limb, such as a wrist. A movement initiated by the limb creates an impetus that disengages the lever from the band portion, and impels the lever outwardly from the band portion. The lever may also be impelled by a pulling or pushing direct force applied thereto. From an outward, operational position, the lever may engage an object, and perform a variety of operations thereto. The limb works with the lever during operation by at least partially providing leverage and torque for the lever. After operation, the limb may once again create sufficient impetus to retract the lever back into the band portion. A lever fastener on the band portion, such as a magnet, may secure the lever onto the band portion. For example, without limitation, the lever includes a bottle opener that extends out from a wrist band to remove a bottle cap. In this example, the bottle opener utilizes a class two lever, whereby the impetus created by the arm and a fulcrum provided by the bottle top are at extreme ends of the lever. However in other embodiments, other types of levers and mechanical advantages may be utilized from the band portion.

In some embodiments, the device includes a band portion configured to manipulate a lever while attached to a limb. The band portion at least partially wraps around the limb, such as a wrist, a forearm, a leg, and an ankle. The limb may create sufficient impetus through various motions, such as swinging an arm, jabbing an arm, and flailing an arm, to impel the lever away from a storage position on the band portion, and towards an operational position away from the band portion. Conversely, the motions may be reversed to create sufficient impetus for the lever to retract back to the band portion.

The band portion engages the limb from an inner surface by at least partially wrapping around the limb. The band portion may include a band fastener on a periphery for fastening opposite ends of the band portion around the limb. In some embodiments, the limb may be free to move and exert a force for creating impetus on the lever while donning the band portion. The band portion further comprises an outer surface. The outer surface includes a lever fastener for helping to secure the lever to the band while in the storage position. The outer surface further comprises at least one auxiliary fastener for fastening at least one auxiliary item to the band portion. The at least one auxiliary item may include, without limitation, a lighter, an illumination device, and a marker.

In some embodiments, the lever may include a beam or rigid rod pivoted at a fixed hinge or mechanism on the band. In one embodiment, the lever comprises a bottle opener that engages a bottle cap for removal. However in other embodiments, the lever may include a knife, a can opener, a variety of kitchen utilities, tools, and instrumentation that work at least partially as a lever and fulcrum and are operable through movements of the limb.

The lever includes a handle end that joins with the outer surface of the band portion. The handle end may join the band surface through a variety of mechanisms, including, without limitation, a hinge that enables the lever to pivot out from the band portion; an extending and retracting rod; a telescoping rod; and a rigid cable. From a storage position, the operational end may fasten to the outer surface of the band portion through the lever fastener, such as a magnet. In any case, the operational end is urged away from the lever fastener, and thus the storage position on the band portion, through the impetus generated by the limb or by a pulling or pushing direct force.

The operational end engages the object, such as a bottle cap. The operational end may include a lip that wedges under the edge of the bottle cap to form a fulcrum. The bottle cap may be pulled off with an upward force applied to the handle end. The limb may provide additional leverage and torque for this operation.

A bottle opener is often difficult to locate, since it may not be used often and is relatively small. A wrist band, which is adorned on a wrist, is accessible and controllable by the limbs. Often, a bottle opener can be used with auxiliary items such as lighters, illumination, and markers.

Although the invention is illustrated and described herein as embodied in retractable bottle opener, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

A force is any influence that causes an object to undergo a certain change, either concerning its movement, direction, or geometrical construction. In other words, a force can cause an object with mass to change its velocity, which includes movement from a state of rest, to accelerate, or a flexible object to deform, or both.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of an object.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
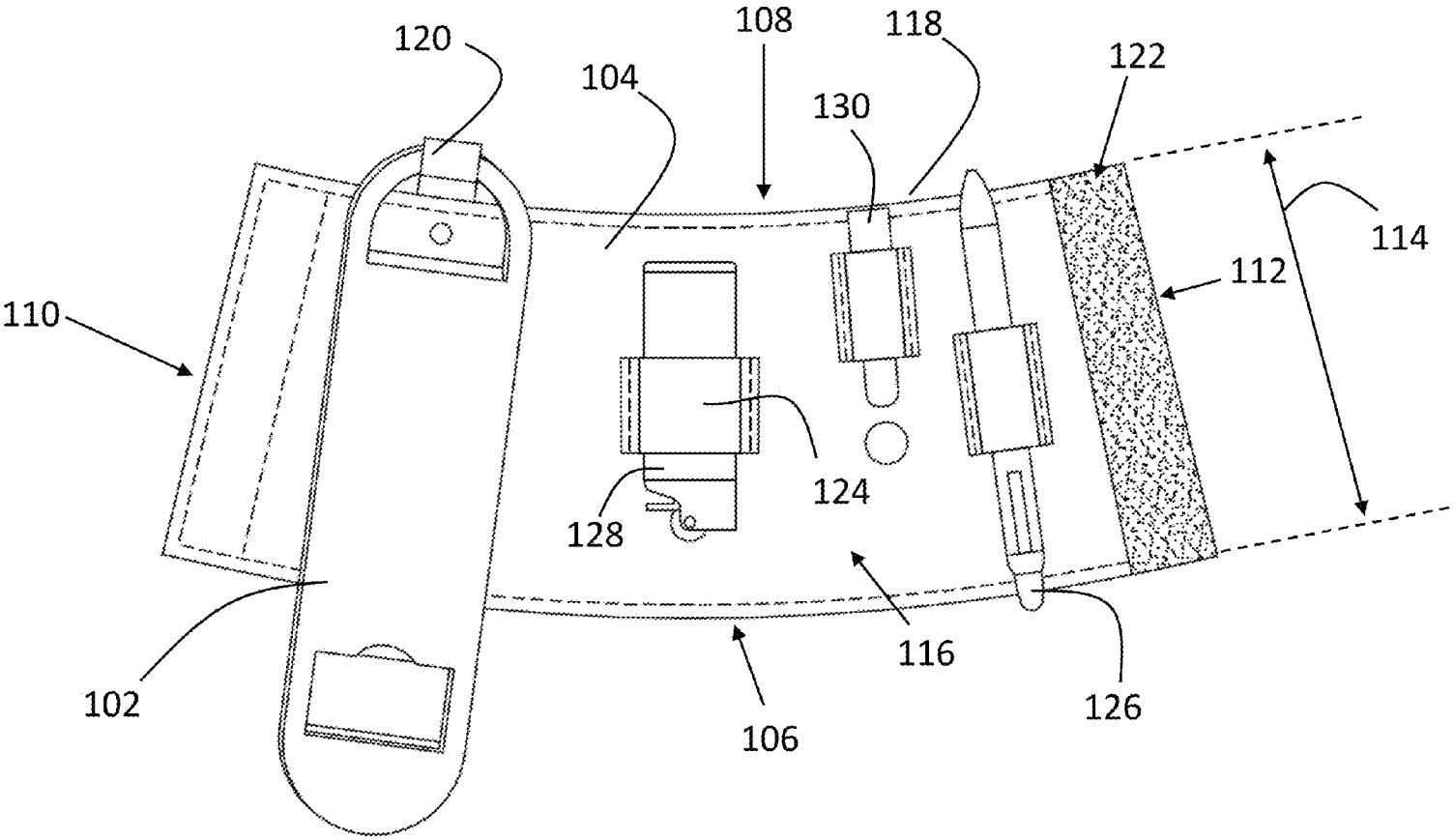
FIG. 1 is a top view of a retractable bottle opener assembly in a storage position in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Figure 6:
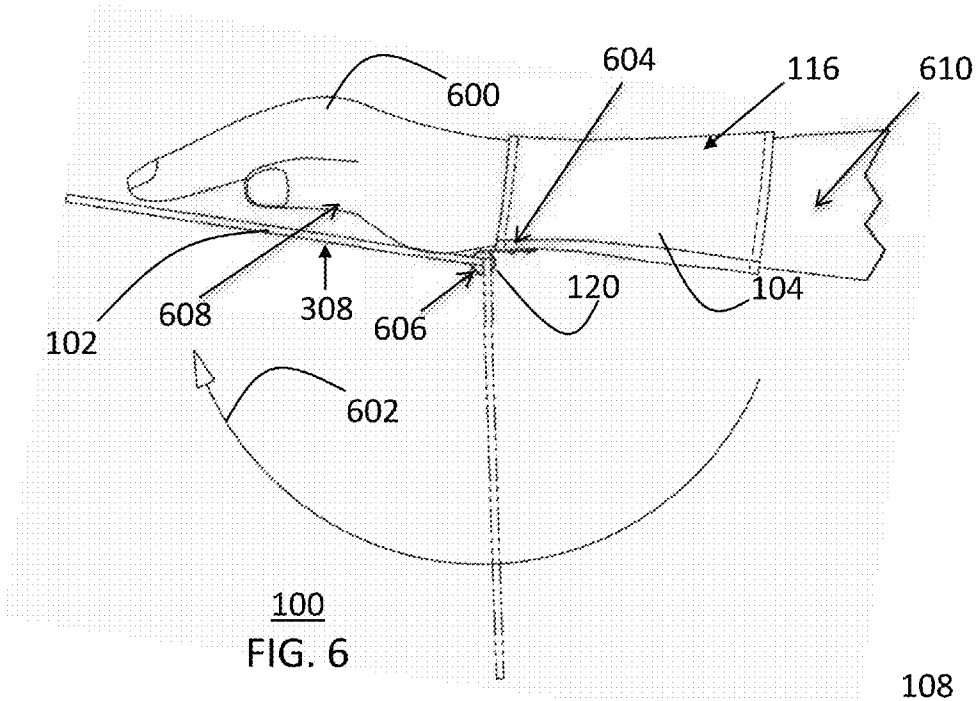
FIG. 6 is a side elevational view of the bottle opener of FIG. 1 coupled to a user and illustrating an exemplary translation path from the storage position to the operational position.

The present invention provides a retractable and wearable bottle opener assembly 100 that, in one embodiment, urges a bottle opener 102, also generally referred to herein as a "lever," out from a storage position (as shown in FIG. 1) on a wrist band 104 to an operational position (shown in FIG. 3) through an impetus (causing a translation path, referred to with arrow 602 in FIG. 6) generated by a limb 600, as shown in FIG. 6. Said another way, the force generated by a user's arm is sufficient to move the bottle opener 102 to the operational position from the storage position. The wrist band 104 is wearable such that it is donned on a limb 600 and capable of enabling a user to have full control of both accessing and operating the bottle opener 102, while retaining the full use of his or her hand.

With reference to FIGS. 1-5 and 6, the wrist band 104 has a first end 106 defining a first aperture (when wrapped around a user's wrist or configured to be wrapped around a user's wrist), a second end 108 opposite the first end 106 and defining a second aperture (when wrapped around a user's wrist or configured to be wrapped around a user's wrist). Said another way, in one embodiment, the wrist band 104 has a left side 110 and a right side 112 that are removably coupleable to one another through an attachment means, e.g., hook-and-loop. When the left side 110 and right side 112 are joined together, the first and second ends 106, 108 define the first and second apertures, respectively.

FIGS. 1-5 and 6 show several advantageous features of the present invention, but, as will be described below, the invention can be provided in several shapes, sizes, combinations of features and components, and varying numbers and functions of the components.

The wrist band 104 can also be seen having a band length 114 spanning from the first end 106 to the second end 108 of the wrist band 104, an outer surface 116, and an inner surface 200 (FIG. 2) defining a channel (when wrapped around a user's wrist or configured to be wrapped around a user's wrist) spanning from the first aperture to the second aperture and sized to receive a user's limb, e.g., a user's arm/wrist area. In one embodiment, the size of the channel is approximately 2-4 inches in diameter. In other embodiments, the size of the channel is greater than 4 inches, but should not be less than approximately 2 inches in diameter The second end 108 also includes a terminal outer edge 118, i.e., where the band 104 terminates.

Figure 3:
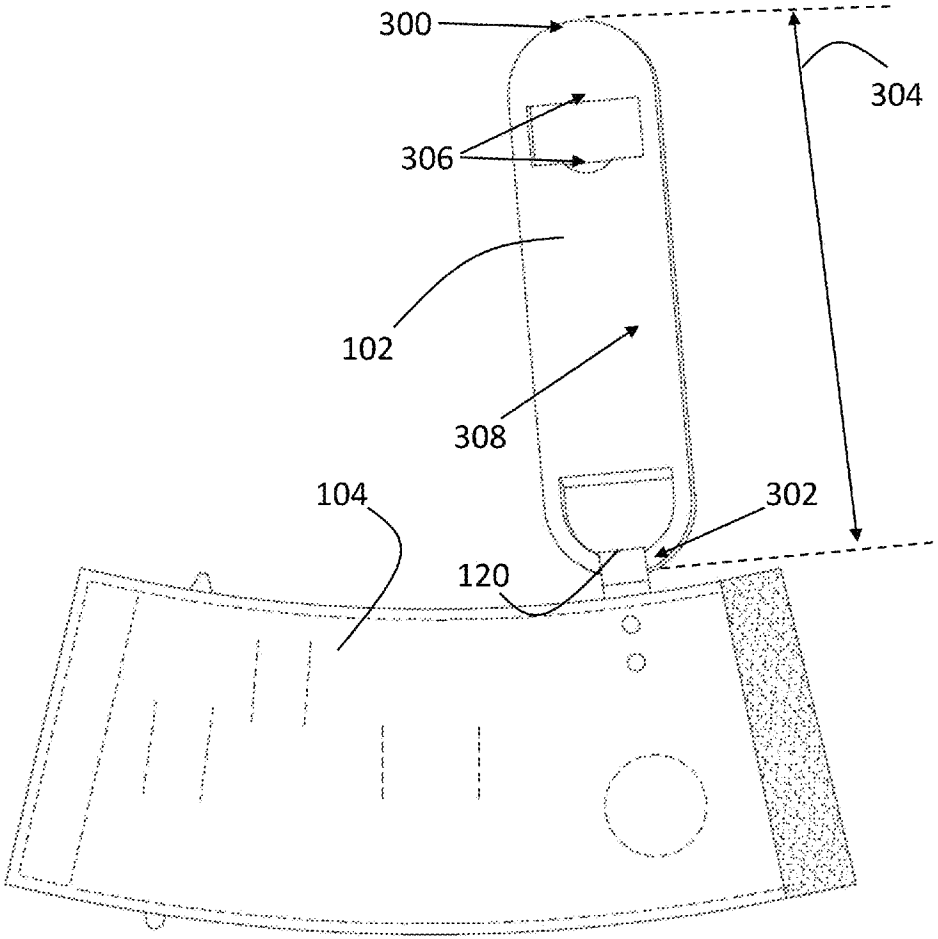
FIG. 3 is a bottom view of the bottle opener of FIG. 1 in an operational position.
Figure 8:
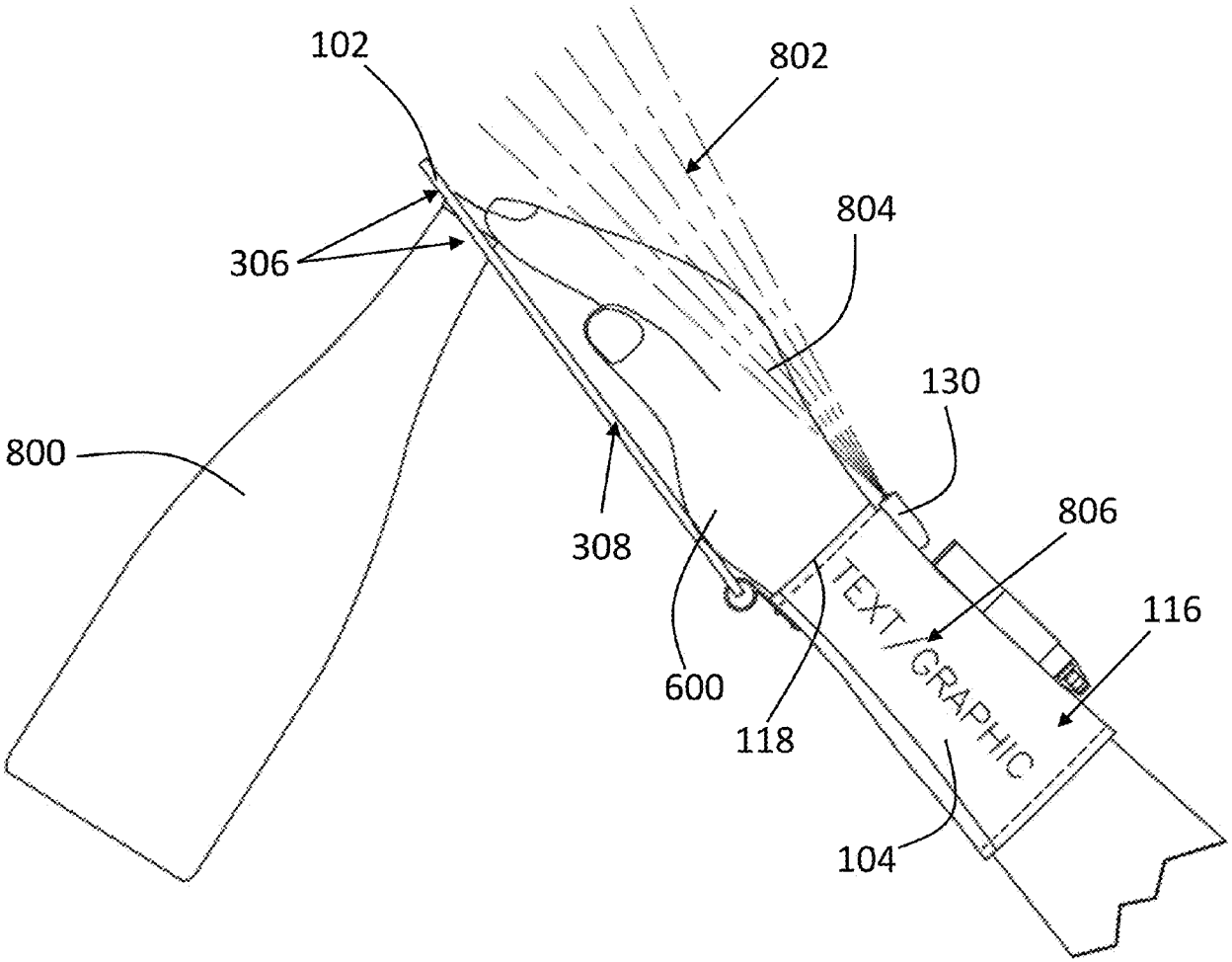
FIG. 8 is a side elevational view of the bottle opener of FIG. 1 coupled to a user and in operation with a bottle, in accordance with an embodiment of the present invention.

With reference to FIG. 3, the bottle opener 102 can be seen coupled to the wearable wrist band 104 and has a first end 300, a second end 302, and an opener length 304 separating the first and second ends 300, 302 of the bottle opener 102. The bottle opener 102 can be seen having a working surface 306 shaped to engage with a bottle 800 (as shown in FIG. 8) and disposed along the opener length 304. In one embodiment, the working surface 306 may be a recessed or undressed portion(s) of the bottle opener 102, as shown in FIG. 3. In other embodiments, the working surface 306 may be a surface of a cork screw or other surface used to open a bottle or can top. Further, it may include a knife, a variety of kitchen utilities, tools, and instrumentation that work at least partially as a lever 102 and are operable through movements of the limb 600. Suitable materials for the opener 102 may include, without limitation, steel, aluminum, metal alloy, wood, and a rigid polymer. The opener 102 has a handle portion 308 disposed along the opener length 304 that is configured for use by the user, i.e., a length and width sufficient for the user to grasp.

With reference now to FIGS. 1, 3, and 6, the assembly 100 has an operational position, e.g., FIG. 6, and a closed position, e.g., FIG. 1. The closed position lies along an opener translation path 602 such that both the working surface 306 and the handle portion 308 are disposed either along the band length 114 or proximal (at or within approximately 3-4 inches) to the first and second ends 106, 108 of the wrist band 104. The operational position lies along the opener translation path 602 such that the working surface 306 and the handle portion 308 are not disposed along the band length 114 and are displaced at a distance removed from the terminal outer edge 118 of the second end 108 of the wrist band 104. In one embodiment, the working surface 306 and the handle portion 308 are displaced approximately 2-3 inches away from the terminal outer edge 118. In other embodiments, the working surface 306 and the handle portion 308 are displaced more than 3 inches or less than 2 inches, but a sufficient distance removed from the outer terminal edge 118, and it's placement on a user's wrist, such that the user may grip the handle portion 308 when in operation.

In one embodiment, the assembly 100 includes a pivot member 120 with a first end 604 directly coupled to the wearable wrist band 104 and a second free end 606 positioned a distance away from the wearable wrist band 104 and pivotably attached to the bottle opener 102. The distance of the free end 606, i.e., not attached to the band 104, may be, in one embodiment, 0.5-2 inches away from the outer surface 116. In other embodiments, it may be less or more than approximately 0.5-2 inches, but should be a distance sufficient to act as a fulcrum for the bottle opener 102 as it moves along the opener translation path 602. The pivot member 120 permits the bottle opener 102 to operably rotate to and from the storage position and the operational position. The free end 606 of the pivot member 120 is preferably positioned at an acute angle with respect to the outer surface 116 so as enable an effective storage position that is not accomplished with the prior known devices.

Figure 5:
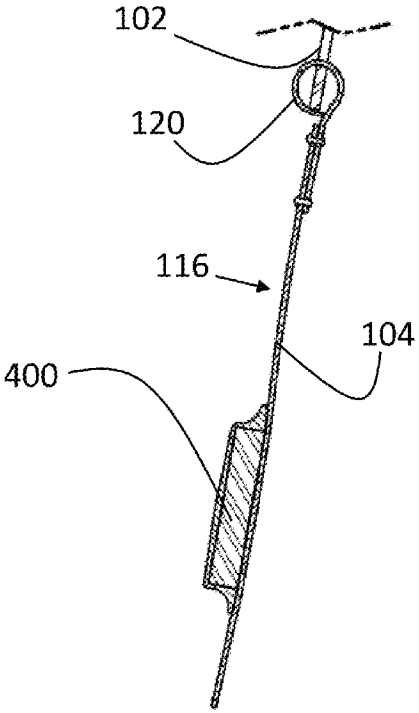
FIG. 5 is a fragmentary cross-sectional view along A-A of FIG. 4.
Figure 4:
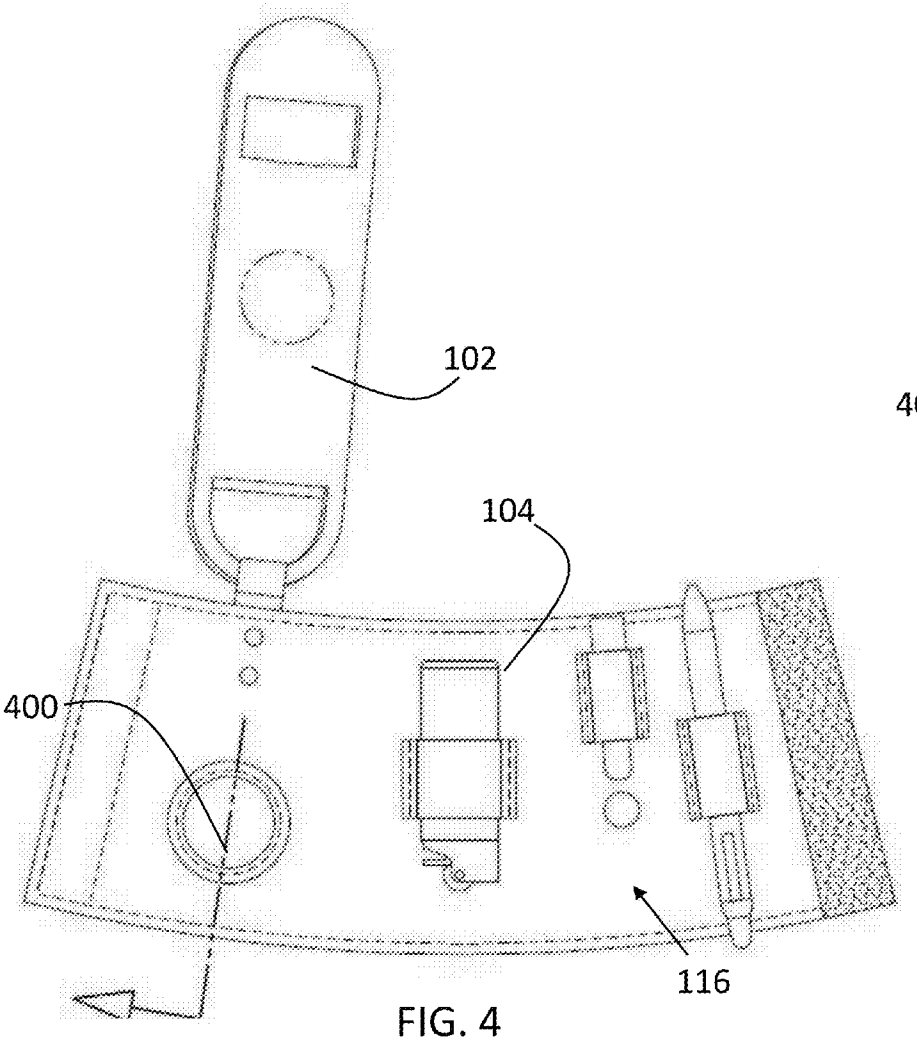
FIG. 4 is a top view of the bottle opener of FIG. 1 in the operational position.

With reference to FIGS. 4 and 5, in one embodiment, the bottle opener 102 is held in the storage position by a magnet 400 operable to retain the bottle opener 102 in the storage position proximal, i.e., adjacent to, to the outer surface 116 of the wearable wrist band 104. The bottle opener 102 may be operably placed in the operational position through an impetus created by the user's limb, the impetus being a force sufficient to overcome a magnetic force used to retain the bottle opener. A cross sectional view of the wearable band 104, along section A-A, depicts an exemplary magnet 400, of any various size, shape, or dimension desired, utilized to retain said bottle opener 102. Therefore, in one embodiment, the bottle opener 102 includes some amount of magnetic material that is conducive to a magnetic field generated by the magnet 400. In other embodiments, a latch, latch-and-key, loop, or other fastening means may be utilized. As shown in FIG. 4, the magnet 400 may be sewn into the wearable wrist band 104, coupled thereto with adhesive, or other fastening means known to those of skill in the art. Similarly, the pivot member 120 can also be seen coupled to the band 104 via thread, adhesive, or other known means.

Therefore, it can be appreciated that in certain embodiments the bottle opener 102 is operably placed in the operational position through an impetus, or force, generated by the movement of a user's arm. The impetus should be a force sufficient to overcome a magnetic field force used to retain the bottle opener 102. In one embodiment, the strength of the magnetic field is approximately 20-75 mT (milliTeslas) and the impetus sufficient to overcome said magnetic field is moving the user's arm in a downward direction away from the magnet 400 with a force of approximately 20-30 $lb_f$. In other embodiments, the one of skill in the art can appreciate that the impetus may be less or greater than the above values, depending on the parameters of the magnet and the user. Beneficially, the user is still able to use his or her arm in normal operation without releasing the opener 102 accidentally.

As such, the impetus to move the opener 102 is generated through controlled movements of the limb 600, e.g., arm, such as an outward or inward swaying of an arm. However in other embodiments, as described below, the opener 102 may be extended and retraced through a direct pulling or pushing force. The storage position may include the opener 102 overlaying and secured to the wrist band 104 through a magnet 400. As discussed above, the operational position may include the opener 102, or lever, fully extended away from the wrist band 104 and engaging an object, such as a bottle top.

The wrist band 104 may at least partially wrap around a wrist. In this manner, a first limb may at least partially provide leverage and torque for operating the opener 102, while a second limb may help manipulate the opener 102 or perform other duties. The wrist band 104 may include a strap of material sized and dimensioned to at least partially wrap around the limb. The wrist band 104 may have sides removably couplable to one another or may be pre-formed and configured to a particular size such that the user may elastically deform it to fit his or her wrist inside the band 104. Suitable materials for the wrist band 104 may include, without limitation, nylon, corduroy, polyester, leather, and a non-woven material. The wrist band 104 at least partially wrap around the limb 600. The limb 600 may include, without limitation, a wrist, a forearm, a leg, an ankle, and any extremity of a human, animal, or robotic body. As described above, the limb 600 may create sufficient impetus through various motions, such as swinging an arm, jabbing an arm, and flailing an arm, to impel or urge the opener 102 away from a storage position on the wrist band 104, and towards an operational position away from the wrist band 104. Conversely, the motions may be reversed to create sufficient impetus for the opener 102 to retract back to the wrist band 104.

Figure 2:
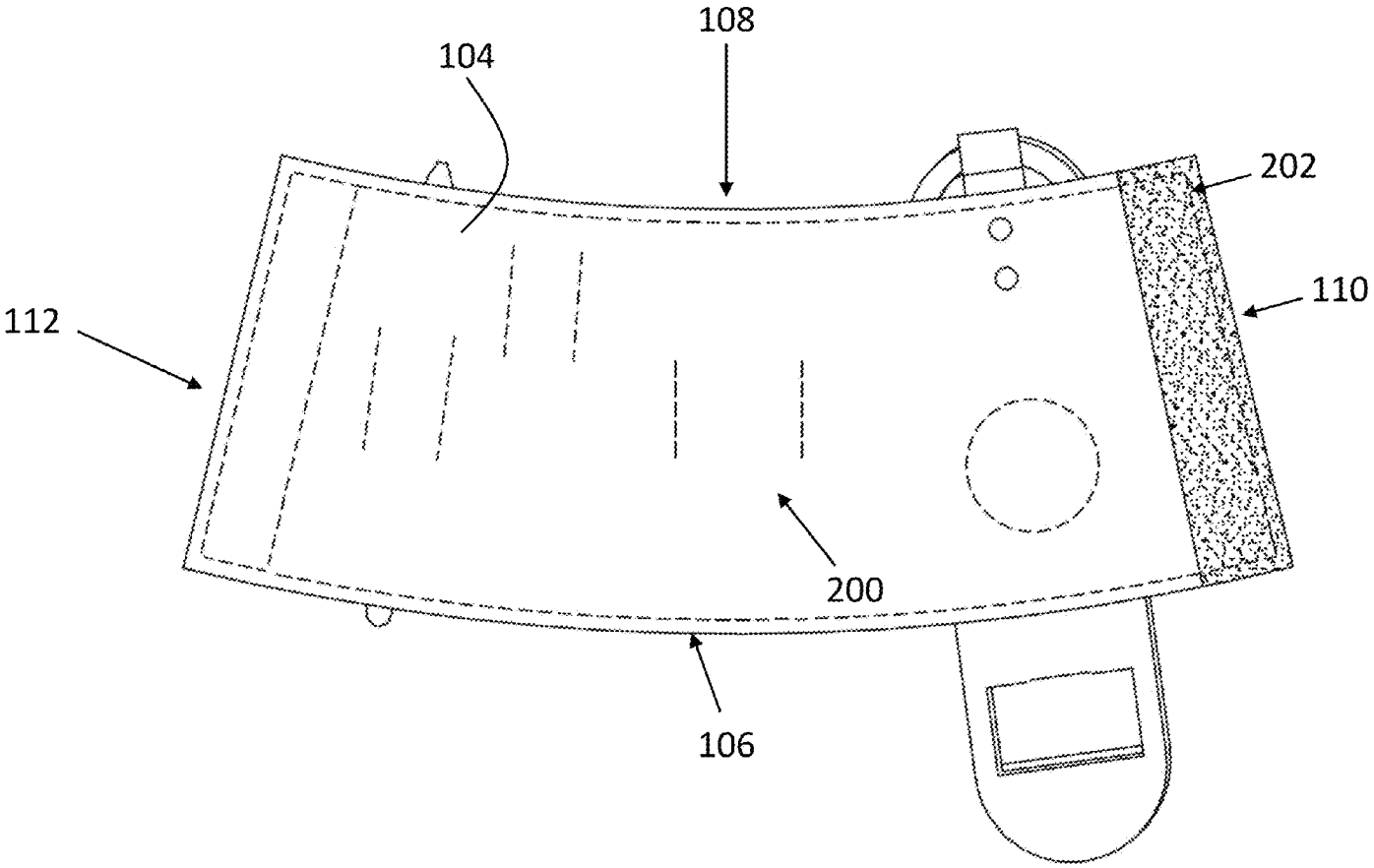
FIG. 2 is a bottom view of the bottle opener of FIG. 1.

With reference to FIGS. 1 and 2, the wrist band 104 may include a band fastener 122, 202 on a periphery for fastening opposite sides 110, 112 of the wrist band 104 around the limb 600. The band fasteners 122, 202 may include, without limitation, a hook and loop fastener, a magnet, a button, a pin, a string, and an adhesive. As depicted in FIG. 1, the wrist band may include one or more fasteners 124 positioned on the outer surface 116 of the wrist band 104 and sized to receive at least one auxiliary item, the at least one auxiliary item including at least one of a writing device 126, a lighter 128, and a light emitting device 130. In other embodiments, the outer surface 116 may include a power switch and/or a power supply. The at least one fastener 124, such as a loop of material, holds each separate auxiliary item in place on the wrist band 104. Therefore, the size of said fastener 124 can be readily ascertainable to those of skill in the art by ascertaining the dimensions of the particular auxiliary item. The bottle opener 102, along with said auxiliary items, such as the lighter, pen, and light are useful tools for operating a bar or restaurant. In other uses of the present invention, other items may serve as a lever 102, e.g., a hair tonic, a small mirror, tweezers, and/or a pair of scissors, such as applications in a beauty salon. In any case, the opener or other lever 102 extends and retracts, while the auxiliary items generally remain accessible from the outer surface 116.

Figure 7:
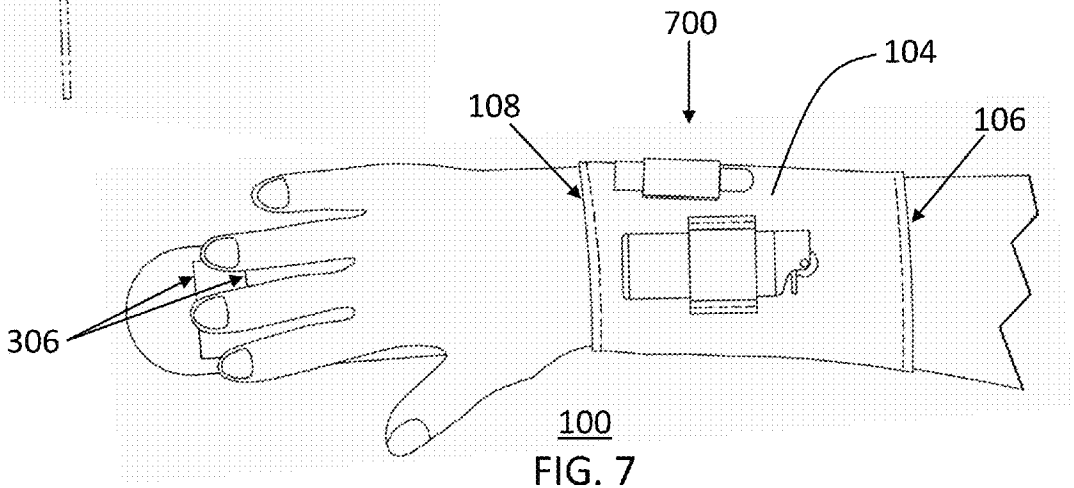
FIG. 7 is a top view of the bottle opener of FIG. 1 coupled to a user and in the operational position.

With reference back to FIGS. 6 and 7, the wearable wrist band 104 can be seen coupled to a wrist-arm area 700 of a user. The wrist-arm area 700 generally spans from a location approximately where the user's palm 608 joins with the distal end of the forearm 610, to a location approximately before the mid-forearm 610. The wearable wrist band 104 can be seen having the first end 106 positioned proximal or adjacent to the wrist area 700 of the user and the second end 108 positioned on a forearm 610 of the user. Therefore, in accordance with one embodiment of the present invention, the assembly 100 can advantageously have the storage position along an opener translation path 602 with both the working surface 306 and the handle portion 308 disposed either along the forearm 610 of the user and/or proximal to the wrist area 700 of the user and an operational position along the opener translation path 602 with both the working surface 306 and the handle portion 308 disposed in a user's hand, i.e., within the area of the palm/fingers of a user or within approximately 2-3 inches from a user's finger tips. In other embodiments, to provide the torque or force sufficient to open a bottle 800, such as the one shown in FIG. 8, the operational position includes the handle portion 308 disposed in the palm 608 of the user's hand 600.

In one embodiment, the opener translation path 602 is of a substantially semi-circular motion, as depicted in FIG. 6. Said another way, the motion of the opener 102 forms a path that is a function equal to a partial circumference of a circle, e.g., any polynomial function. This may include movements that advantageous provide the means for the opener 102 to move from the storage position, which is discrete and relatively un-noticed, to an operational position where the opener 102 can be effectively utilized by the user. In other embodiments, the assembly 100 may uniquely utilize an opener translation path 602 that is of a linear motion, or that which is in a straight or relatively straight line.

With specific reference to FIG. 8, the opener 102 includes the working surface 306 for engaging the object 800, such as a bottle cap. The operational end or working surface 306 may include a lip or recessed portion, shown in FIG. 3, which wedges under the edge of the bottle cap to form a fulcrum. The lip is configured to form a fulcrum with the object 800. The fulcrum is operable to provide a mechanical advantage for the opener 102 during operation. Those skilled in the art will recognize that the fulcrum between the lip on a bottle opener and a bottle cap forms a fulcrum at an extreme distance from the source of the impetus. In the present example, the bottle cap may be pulled off at the junction of the lip and the bottle cap with an upward force applied to the handle portion 308. The limb 600 may provide additional leverage and torque for this operation. However in other embodiments, the operational end of the opener 102 may include, without limitation, a sharp knife, a can opener, a lighter, and a tool or instrument controllable by the limb 600.

In some embodiments, one of the exemplary auxiliary items may include an electrical lighting device(s) 130 sized to integrate into the wrist band 104. Said another way, a light emitting device 130 may be operable to emit a light 802 in a direction toward the user's hand 804. Therefore, the front end of the light 130 may protruded over or lay proximal to the outer terminal edge 118 of the band 104. The light emitting device 130, e.g., a flashlight, may be removable form the wrist band 104 or it may be fixedly coupled to the band 104 so that it is not readily removed. In one embodiment, the light 802 is only emitted when the bottle opener 102 is placed in the operational position, as shown in FIG. 8. In other embodiments, the light 802 is emitted based on the user's preference or desired application.

Additionally, the outer surface 116 may include a marking portion 806 for displaying text, graphics, and ornamental designs. In one embodiment, the marking portion 806 is configured to display at least one of an illuminated text, graphics, and other decorative markings to a viewing public. This is extremely beneficial for those applications where the assembly 100 is used in connection with low ambient light, e.g., at night or in a dimly lit bar. The marking portion 806 may be utilized for advertising. For example, without limitation, the marking portion 806 displays a logo for a beer company in a bar, while the lever 102 removes a bottle cap from a beer bottle. Illumination of the text, graphics, etc. may occur through use of one or more LEDs or a light pipe configured to display the desired text.

In other embodiments of the present invention, various other mechanisms for enabling movement of an opener in an assembly may include, without limitation, an extending and retracting rod, a telescoping rod, a spring, and a rigid cable.

Figure 9:
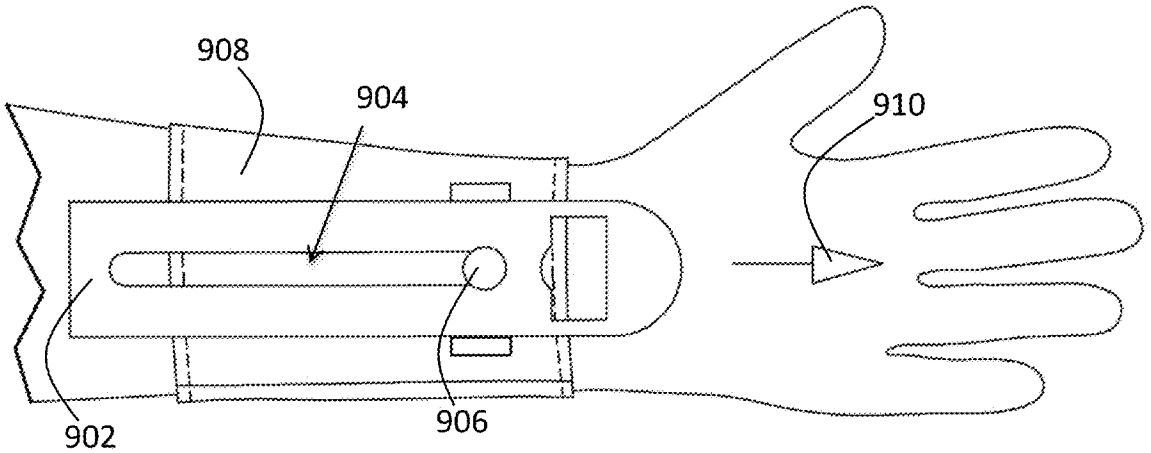
FIGS. 9 and 10 depict bottom views of a retractable bottle opener assembly in a storage position and an operational position, respectively, in accordance with another embodiment of the present invention.
Figure 10:
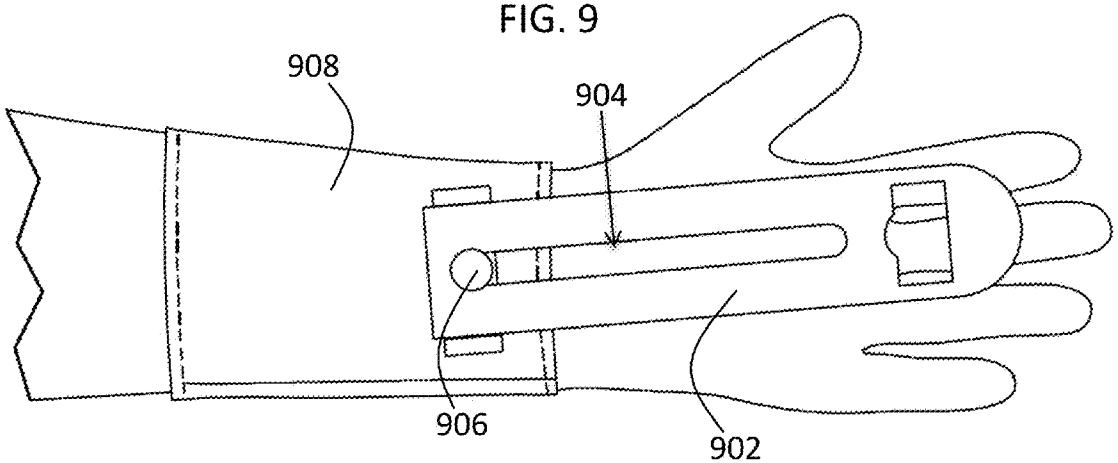

With reference to FIGS. 9 and 10, another exemplary embodiment of a retractable bottle opening assembly 900 is shown in bottom views. A sliding mechanism 902, i.e., a bottle opener, is configured to slidably extend and retract between a storage position (FIG. 9) and an operational position (FIG. 10). The opener 902 is slotted 904 for enabling slidable movement between the storage position and the operational position. This slideable movement is indicated by the arrow 910. The slot 904 engages a pin 906 or other member that is shaped to engage with the slot 904 such that there is a male-female mating relationship. The pin 906 serves to guide the slotted lever 902 and also to restrict slidable movement of the slotted lever 902 when extended out to the operational position. In other embodiments, the opener 902 may have a male member and the wrist band 908 may have the slotted aperture. The slotted lever 102 also includes an operational end for engaging an object and a handle portion, as previously described.

In certain embodiments, the assembly 900 may utilize a spring-like device (not shown) coupled to the wearable wrist band 908. The spring-like device is operable to impel the bottle opener 902 to at least one of the storage position to the operational position. As such, in one embodiment, the opener 902 may retract into the wrist band 104 along a track with angled teeth that provide for translation in one direction, e.g., into a storage position, but not translation in another direction, e.g., toward the operational position. The opener 902 may be biased by a spring-like device, which is any structure having permitting elastic deformation and storing mechanical energy, e.g., a spring, when moved into the storage position. The track may be moveable in a direction away from the translation direction of the opener 902, through a button for example, such that it would be impelled in the operational position.

Figure 11:
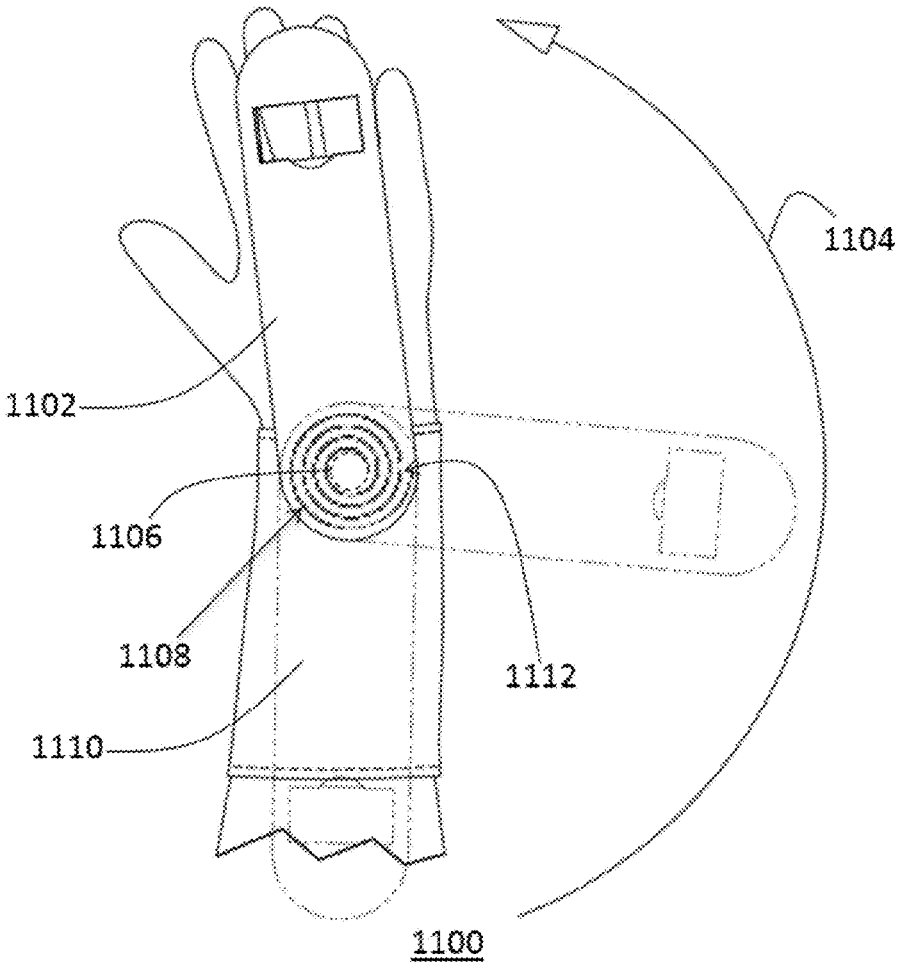
FIG. 11 depicts a bottom view of a retractable bottle opener assembly moving from a storage position and an operational position, in accordance with another embodiment of the present invention.

In other embodiments of the bottle opener assembly 1100, as shown in the bottom view of FIG. 11, the bottle opener 1102 moves between the storage position and the operational position through a lateral (with respect to the surface of the wrist band) rotational movement 1104. This movement may, in one embodiment, be accomplished through a spring-like device 1112, e.g., a balance spring or hairspring, utilizing a spring release mechanism. The spring release mechanism, e.g., a button 1106, provides a quick, triggered mechanism for extending the opener 1102 into the operational position. In this embodiment, the impetus generated by the user's limb may not be necessary, as a spring that is biased towards the operational position impels the opener 1102 outwardly. In other embodiments, a magnet or other fastener may be used to retain the opener 1102 in the storage position. In some embodiments, the end 1108 joins the wrist band 1110 at the spring release mechanism 1106. The spring release mechanism 1106 may also be placed at other locations along the opener length. The spring-like device 1112 may be biased to impel the opener 1102 towards the outward, operational position, or towards the inward, storage position. In some embodiments, the spring release mechanism 1106 includes a lock (not shown) that fastens the opener 1102 in the storage or operational position.

Figure 12:
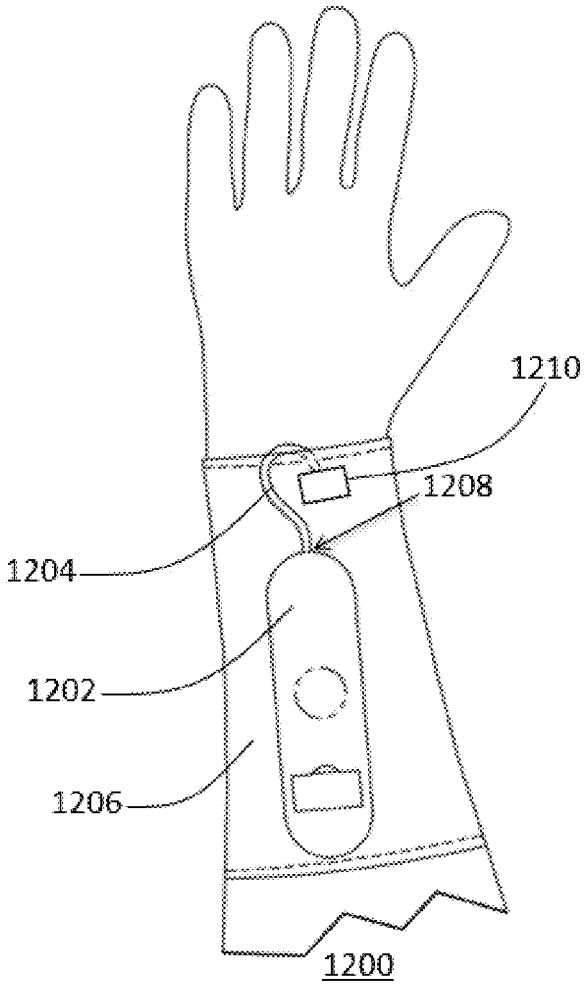
FIG. 12 depicts a bottom view of a retractable bottle opener assembly utilized with a cord in accordance with another embodiment of the present invention.

With reference now to FIG. 12, in other embodiments, the opener 1202 of assembly 1200 moves between a storage position and an operational position through a retractable cable 1204 and/or a cable 1204 utilized with a fastener, such as a magnet—as discussed above. When utilizing a retractable cable 1204, the assembly 1200 includes a reel 1210 coupled to the wearable wrist band 1206. The reel 1210, or a cylindrical member used to retain wound cord, or other pliable material, is used with a retractable and pliable cord 1204, e.g., metallic cable, polymer based material, or other fibers, cord, or rope with pliable (repeated bending, at a 360 degree rotation, without fracture) properties. The cord 1204 has a first end (not shown) directly coupled to the reel 1210 and a second end 1208 attached to the bottle opener 1202. The bottle opener 1202 is thereby operably placed in the storage position and the operational position by the cord, which may also be biased in a particular direction by the spring-like device 1112 (FIG. 11).

Figure 13:
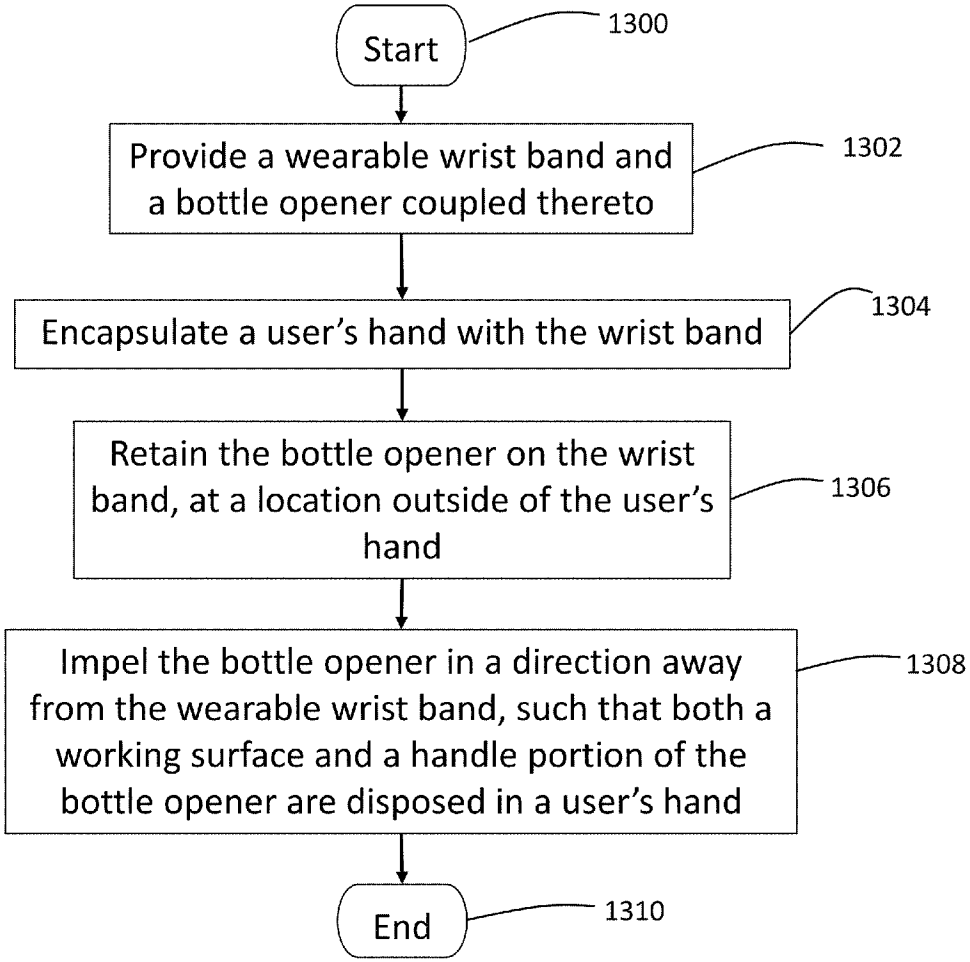
FIG. 13 depicts a process flow diagram of a method of storing and using a wearable bottle opener in accordance with the present invention.

With reference to FIG. 13, a process flow diagram depicting a method of using and storing a wearable bottle opener is shown. The process starts at step 1300 and immediately proceeds to step 1302 of providing a wearable wrist band and a bottle opener coupled thereto. As discussed above, the wrist band has a first end defining a first aperture, a second end, opposite the first end, and defining a second aperture. The band has a band length spanning from the first end to the second end of the wrist band, an outer surface, and an inner surface defining a channel spanning from the first aperture to the second aperture. The channel is sized to receive a user's arm as described above. The process continues to step 1304 of encapsulating the wearable wrist band to the user's arm such that the first end of said band is positioned proximal to a wrist area of a user and the second end is positioned on a forearm of the user.

Next, step 1306 includes retaining the bottle opener on the wearable wrist band such that both the working surface and the handle portion are disposed either along the forearm of the user and/or proximal to the wrist area of the user. This provides an advantageous storage position that permits a user to continue to have normal use of his or her hand, while simultaneously storing the bottle opener for efficient and effective use, when desired. Next, the process continues to step 1308 of impelling the bottle opener in a direction away from the wearable wrist band such that both the working surface and the handle portion are disposed in a user's hand. The process terminates at step 1310.

A retractable lever, or bottle opener, impelling device has been disclosed that impels the lever from a storage position on a user's wrist band to the operational position with, in one embodiment, an impetus generated by the limb of a user. In other embodiments, the lever may move to and from the storage and operation positions in other means, as more fully described above.

What is claimed is:

1. A retractable bottle opener comprising:

a wearable wrist band coupled to a wrist-arm area of a user, the wearable wrist band having a first end positioned proximal to the wrist area of the user, a second end opposite the first end and positioned on a forearm of the user, a band length spanning from the first end to the second end of the wrist band, a magnet coupled thereto, an outer surface, and an inner surface; and a bottle opener coupled to the wearable wrist band and having:

a first end, a second end, and an opener length separating the first and second ends of the bottle opener;

a working surface shaped to engage with a bottle and disposed along the opener length;

a handle portion disposed along the opener length;

a storage position along an opener translation path with both the working surface and the handle portion disposed at least one of along the forearm of the user and proximal to the wrist area of the user, the bottle opener held in the storage position with the magnet and, the bottle opener being oriented longitudinally from the first end of the wearable wrist band toward the second end of the wearable wrist band, the magnet having a magnetic force sufficient to retain a weight of the bottle opener; and an operational position along the opener translation path with both the working surface and the handle portion disposed in a user's hand, wherein the bottle opener is rotatably placed in the opener translation path with a force sufficient to overcome the magnetic force used to retain the bottle opener.

2. The retractable bottle opener according to claim 1, wherein:

the operational position includes the handle portion disposed in a palm of the user's hand.

3. The retractable bottle opener according to claim 1, further comprising:

a pivot member with a first end directly coupled to the wearable wrist band and a second free end positioned a distance away from the wearable wrist band and pivotably attached to the bottle opener, wherein the bottle opener is operably rotated to and from the storage position and the operational position.

4. The retractable bottle opener according to claim 1, wherein the magnet is operable to retain the bottle opener in the storage position proximal to the outer surface of the wearable wrist band.

5. The retractable bottle opener according to claim 1, wherein the opener translation path is of a substantially semicircular motion.

6. The retractable bottle opener according to claim 1, wherein the opener translation path is of a linear motion.

7. The retractable bottle opener according to claim 1, further comprising:

an elastic device coupled to the wearable wrist band and operable to impel the bottle opener to at least one of the storage position to the operational position.

8. The retractable bottle opener according to claim 1, wherein the wearable wrist band further comprises:

a light emitting device operably emitting a light in a direction toward the user's hand only when the bottle opener is placed in the operational position.

9. A retractable bottle opener comprising:

a wearable wrist band with a first end defining a first aperture, a second end opposite the first end and defining a second aperture, a band length spanning from the first end to the second end of the wrist band, a magnet coupled thereto, an outer surface, and an inner surface defining a channel spanning from the first aperture to the second aperture and sized to receive a user's limb, the second end including a terminal outer edge; and a bottle opener coupled to the wearable wrist band and having:

a first end, a second end, and an opener length separating the first and second ends of the bottle opener;

a working surface shaped to engage with a bottle and disposed along the opener length;

a handle portion disposed along the opener length;

a storage position along an opener translation path with both the working surface and the handle portion disposed at least one of along the band length and proximal to the first and second ends of the wrist band, the bottle opener held in the storage position with the magnet and, the bottle opener being oriented longitudinally from the first end of the wearable wrist band toward the second end of the wearable wrist band, the magnet having a magnetic force sufficient to retain a weight of the bottle opener; and an operational position along the opener translation path with the working surface and the handle portion not disposed along the band length and displaced at a distance removed from the terminal outer edge of the second end of the wrist band, wherein the bottle opener is rotatably placed in the opener translation path with a force sufficient to overcome the magnetic force used to retain the bottle opener.

10. The retractable bottle opener according to claim 9, further comprising:

a pivot member with a first end directly coupled to the wearable wrist band and a second free end positioned a distance away from the wearable wrist band and pivotably attached to the bottle opener, wherein the bottle opener is operably rotated to and from the storage position and the operational position.

11. The retractable bottle opener according to claim 9, wherein the magnet is operable to retain the bottle opener in the storage position proximal to the outer surface of the wearable wrist band.

12. The retractable bottle opener according to claim 11, wherein the bottle opener is operably placed in the operational position through an impetus created by the user's limb, the impetus being a force sufficient to overcome a magnetic force used to retain the bottle opener.

13. The retractable bottle opener according to claim 9, wherein the opener translation path is of a substantially semicircular motion.

14. The retractable bottle opener according to claim 9, wherein the opener translation path is of a linear motion.

15. The retractable bottle opener according to claim 9, wherein the channel is sized to receive a user's wrist.

16. The retractable bottle opener according to claim 9, wherein the wearable wrist band further comprises:

a fastener positioned on the outer surface of the wrist band and sized to receive at least one auxiliary item, the at least one auxiliary item including at least one of a writing device, a lighter, and a light emitting device.

17. The retractable bottle opener according to claim 9, wherein the wearable wrist band further comprises:

a marking portion configured to display at least one of an illuminated text, graphics, and other decorative markings.

18. The retractable bottle opener according to claim 9, further comprising:

a reel coupled to the wearable wrist band; and a retractable and pliable cord with a first end directly coupled to the reel and a second end attached to the bottle opener, wherein the bottle opener is operably placed in the storage position and the operational position by the cord.

19. A method of using and storing a wearable bottle opener, comprising the steps of:

providing a wearable wrist band and a bottle opener coupled thereto, the wrist band having a magnet coupled thereto, a first end defining a first aperture, a second end opposite the first end and defining a second aperture, a band length spanning from the first end to the second end of the wrist band, an outer surface, and an inner surface defining a channel spanning from the first aperture to the second aperture and sized to receive a user's arm, the bottle opener having an opener length separating a first end and a second end of the bottle opener, the bottle opener being oriented longitudinally from the first end of the wearable wrist band toward the second end of the wearable wrist band, a working surface shaped to engage with a bottle, and a handle portion;

encapsulating the wearable wrist band to the user's arm such that the first end is positioned proximal to a wrist area of a user and the second end is positioned on a forearm of the user;

retaining the bottle opener on the wearable wrist band such that both the working surface and the handle portion are disposed at least one of along the forearm of the user and proximal to the wrist area of the user; and impelling the bottle opener in a direction away from the wearable wrist band through an impetus generated by a user's arm such that both the working surface and the handle portion are disposed in a user's hand, the impetus being a force sufficient to overcome a magnetic force of the magnet used to retain the bottle opener.

* * * * *